US007141128B2

(12) United States Patent
Kuenzler et al.

(10) Patent No.: US 7,141,128 B2
(45) Date of Patent: Nov. 28, 2006

(54) INTERMETALLIC MATERIAL AND USE OF THIS MATERIAL

(75) Inventors: Andreas Kuenzler, Baden (CH); Mohamed Nazmy, Fislisbach (CH); Markus Staubli, Dottikon (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 10/524,889

(22) PCT Filed: Jul. 24, 2003

(86) PCT No.: PCT/CH03/00503

§ 371 (c)(1),
(2), (4) Date: Nov. 14, 2005

(87) PCT Pub. No.: WO2004/016819

PCT Pub. Date: Feb. 26, 2004

(65) Prior Publication Data

US 2006/0127660 A1 Jun. 15, 2006

(30) Foreign Application Priority Data

Aug. 16, 2002 (CH) ..... 1406/02

(51) Int. Cl.
*C22C 19/05* (2006.01)
*C23C 30/00* (2006.01)

(52) U.S. Cl. ..... 148/428; 420/443; 420/445

(58) Field of Classification Search ..... 148/428; 420/443, 445

See application file for complete search history.

(56) References Cited

U.S. PATENT DOCUMENTS 3,928,026 A 12/1975 Hecht et al.
4,447,503 A * 5/1984 Dardi et al. ..... 428/632
4,655,857 A * 4/1987 Masumoto et al. ..... 148/423
5,780,116 A * 7/1998 Sileo et al. ..... 427/456
6,241,469 B1 6/2001 Beeck et al.
6,312,218 B1 11/2001 Beeck et al.
6,458,318 B1 * 10/2002 Nishiyama et al. ..... 420/448

FOREIGN PATENT DOCUMENTS

| | | |
|---|---|---|
| DE | 32 03 869 C2 | 8/1983 |
| DE | 32 35 230 C2 | 3/1984 |
| DE | 199 12 701 A1 | 9/2000 |
| EP | 0 132 667 B1 | 2/1985 |
| EP | 0 916 897 A2 | 5/1999 |
| EP | 1 076 157 | 2/2001 |
| EP | 1 076 157 A2 | 2/2001 |
| GB | 607 616 | 9/1948 |
| GB | 1 456 554 | 11/1976 |
| WO | 95 12004 | 5/1995 |

OTHER PUBLICATIONS

Haugsrud, Reidar et al., On the Oxidation of Ni-23Co-17Cr-12A1-0.5Y Alloy Serving as Bond Coat in Thermal Barrier Coatings; Database CA Online!, Chemical Abstracts Service, Columbus, Ohio, and High Temperature Material Processes, 2000, pp. 339-350, New York.

VDI Berichte 1151, Verein Deutscher Ingenieure, VDI-Gesellschaft Werkstofftechnik, Effizienzsteigerung Durch Innovative Werkstofftechnik, Werkstofftag '95, Tagung Aachen, 15. und 16. Marz, 1995, VDI Verlag.

* cited by examiner

*Primary Examiner*—Sikyin Ip
(74) *Attorney, Agent, or Firm*—Buchanan Ingersoll & Rooney PC

(57) ABSTRACT

The invention discloses an intermetallic material consisting of the following composition by weight percent: 10% Al, 22% Cr, 36% Co, 0.2% Y, 0.2% Hf, 2% Ta, 3% Fe, remainder Ni and inevitable impurities. The invention also describes its use as a layer protecting against high temperatures and at locations of thermal turbomachines which are subject to friction or vibration.

10 Claims, 4 Drawing Sheets

INTERMETALLIC MATERIAL AND USE OF THIS MATERIAL

FIELD OF THE INVENTION

The invention relates to an intermetallic material and to the use of this material as felt and/or as a layer protecting against high temperatures.

DISCUSSION OF BACKGROUND

The guide vanes and rotor blades of gas turbines are exposed to strong loads. To keep the leakage losses from the gas turbine at low levels, by way of example the rotor of the gas turbine is fitted with a very small amount of play with respect to the stator, so that a stripping action occurs. A honeycomb structure is provided at the stator of the gas turbine. The honeycomb structure comprises a metal alloy which is able to withstand high temperatures. A further design involves the use of smooth, coated or uncoated heat shield segments (HSS) which are positioned radially opposite the rotating blade at the outer radius. The blade tip then rubs against these heat shield segments. To prevent the blade tip itself from being abraded, the tip may be coated in order then to abrade the heat shield segments to a greater extent. However, one drawback of this embodiment is that the coating has only a limited adhesion to the turbine blade. A further drawback is that cooling-air bores, with which either the heat shield segment and/or the blade may be provided, become blocked during the frictional action.

It is known from documents DE-C2 32 35 230, EP 132 667 or DE-C2 32 03 869 to use metal felts at various locations of gas turbine components, for example at the tip of a turbine blade or vane (DE-C2 32 03 869), between a metal core or a ceramic outer skin (DE-C2 32 35 230) or as a cladding of the turbine blade or vane (EP-B1 132 667). However, these embodiments have the drawback that the metal felt which is used is insufficiently resistant to oxidation. The increases in the hot-gas temperatures, for example in modern gas turbines, lead to the materials used having to satisfy ever greater demands. However, the metal felts in the abovementioned documents no longer satisfy the requirement to current levels, in particular with regard to the required resistance to oxidation. U.S. Pat. No. 6,241,469 B1, U.S. Pat. No. 6,312,218 B1, DE-A1 199 12 701, EP-A2 0 916 897 and EP-A2 1 076 157 have disclosed metal felts which are composed of an intermetallic alloy. These felts consist of sintered and pressed intermetallic fibers, and on account of the intermetallic phases have significantly improved materials properties than the abovementioned materials in terms of strength, resistance to oxidation, deformability and abradability. Metallic high-temperature fibers have also been described in VDI Report 1151, 1995 (*Metallische Hochtemperaturfasern durch Schmelzextraktion—Herstellung, Eigenschaften, Anwendungen*) [Metallic high-temperature fibers through melt extraction—production, properties, uses].

SUMMARY OF THE INVENTION

The invention as characterized in the independent claims achieves the object of improving the materials properties of intermetallic alloys still further, such that they can be used as a felt or as a layer protecting against high temperatures on gas turbine components which are subject to high levels of thermal load. By suitable selection of the composition of the intermetallic alloy, it is to have a sufficient strength, resistance to oxidation, deformability, abradability and sufficient vibration-damping properties.

The present invention also relates to an intermetallic material, consisting of the following composition, by weight percent: 8–15% A1, 15–25% Cr, 20–40% Co, 0–5% Ta, 0–0.03% La, 0–0.5% Y, 0–1.5% Si, 0–1% Hf, 0–0.2% Zr, 0–0.2% B, 0–0.01% C, 0–4% Fe, remainder Ni and inevitable impurities, and in particular of (by weight percent): 12% Al, 22% Cr, 36% Co, 0.2% Y, 0.2% Hf, 3% Fe, remainder Ni and inevitable impurities, or of 10% Al, 22% Cr, 36% Co, 0.2% Y, 0.2% Hf, 2% Ta, 3% Fe, remainder Ni and inevitable impurities.

On account of its materials properties, an intermetallic material of this type can advantageously be used as a high-temperature coating for the turbine blades or vanes or other components, for example.

It is also conceivable for the material to be used as an intermetallic felt on components which are subject to friction in thermal turbomachines. These components may, for example, be the rotor or stator, the tip of a turbine blade or vane, the heat shield segments arranged opposite the turbine blade or vane or the platform of the turbine blade or vane. A further advantage accrues if the intermetallic felt is covered with a ceramic material, since very good bonding of the ceramic material is achieved on the rough surface of the intermetallic felt. As a result, by way of example, the tip of the guide vane or rotor blade is well protected against the actions of heat and against mechanical effects caused by friction. A further advantage arises from the fact that cooling-air bores do not become blocked through abrasion during operation, since this is a porous material. Moreover, the intermetallic felt also has sufficient vibration-absorbing properties.

BRIEF DESCRIPTION OF THE DRAWINGS

The invention is explained with reference to the appended drawings, in which.

Only the elements which are pertinent to the invention are illustrated. Identical elements are denoted by the same reference symbols throughout the various figures.

DETAILED DESCRIPTION OF THE PREFERRED EMBODIMENTS

Figure 1:
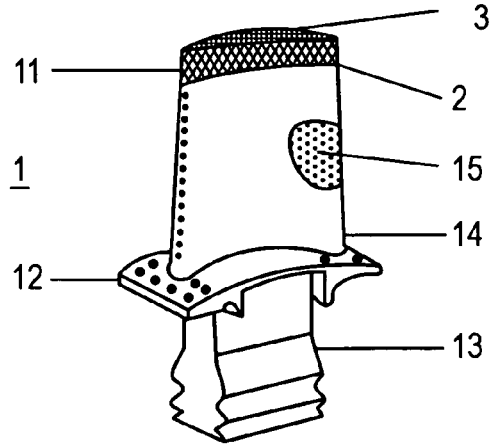
FIG. 1 shows an embodiment of a turbine blade or vane according to the invention with an intermetallic felt at the tip.

FIG. 1 illustrates a turbine blade or vane 1 having a tip 11, a main blade or vane part 14, a platform 12 and a blade or vane root 13. This may, for example, be a guide vane or rotor blade of a gas turbine or of a compressor. An intermetallic felt 2 according to the invention is arranged at the tip 11 of this turbine blade or vane 1. The intermetallic felt 2 was based on an Ni—Co aluminide. To achieve a sufficient strength, resistance to oxidation and deformability, the elements Ta, Cr, Y have been added. A composition according to the invention of the Ni—Co aluminide is given in Table 1.

Composition of the intermetallic alloy according to the invention (indicating an Ni—Co aluminide)

TABLE 1

Nickel-cobalt aluminides (details in weight percent)

| Ni | Al | Cr | Co | Ta | Y | Si | C | La | Hf | Zr | B | Fe |
|---|---|---|---|---|---|---|---|---|---|---|---|---|
| Remainder | 8–15% | 15–25% | 20–40% | 0–5% | 0–0.5% | 0–1.5% | 0–0.1% | 0–0.03% | 0–1% | 0–0.2% | 0–0.2% | 0–4% |

Figure 7:
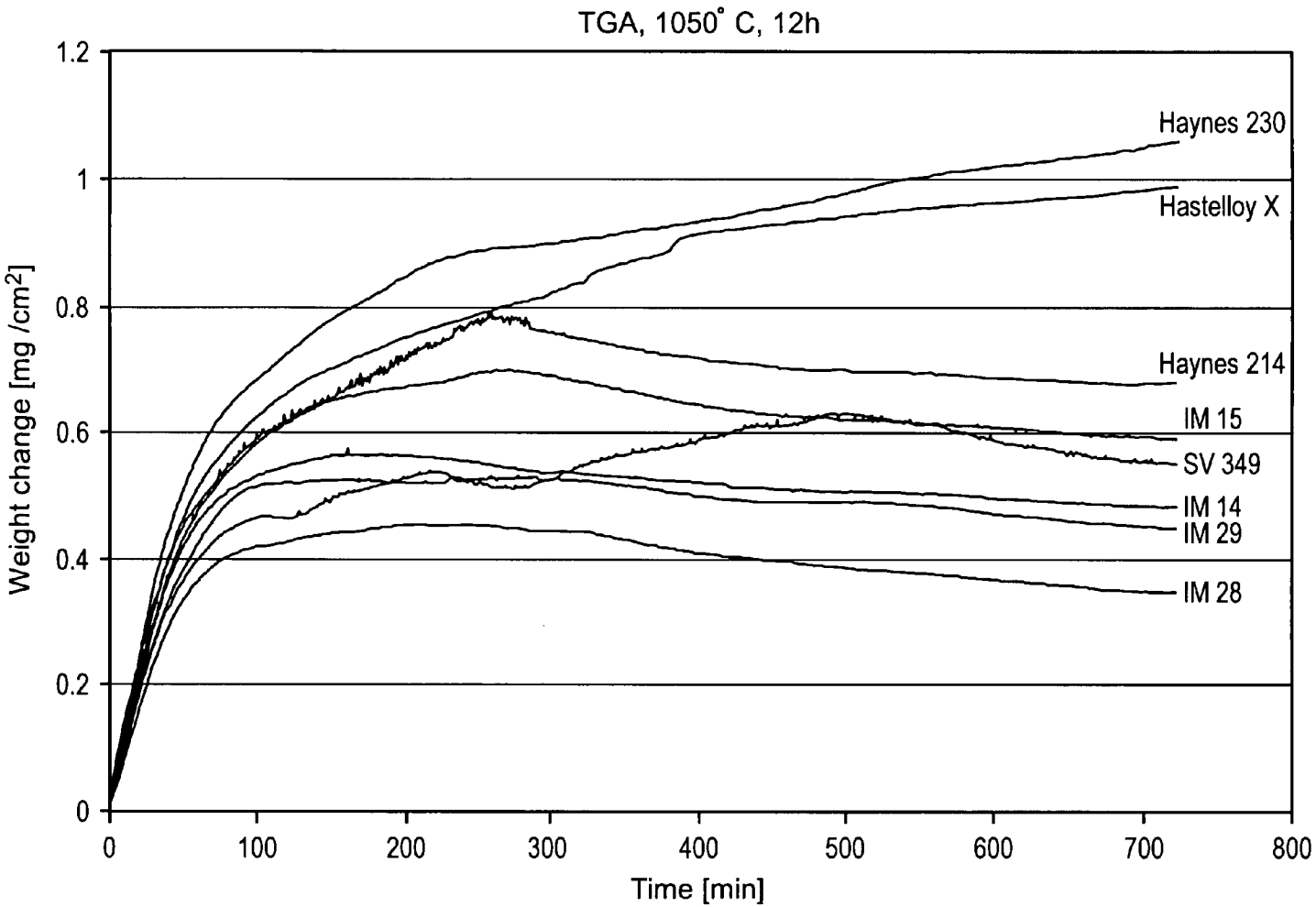
FIG. 7 shows an illustration of the oxidation properties of various materials at a temperature of 1050° C.
Figure 8:
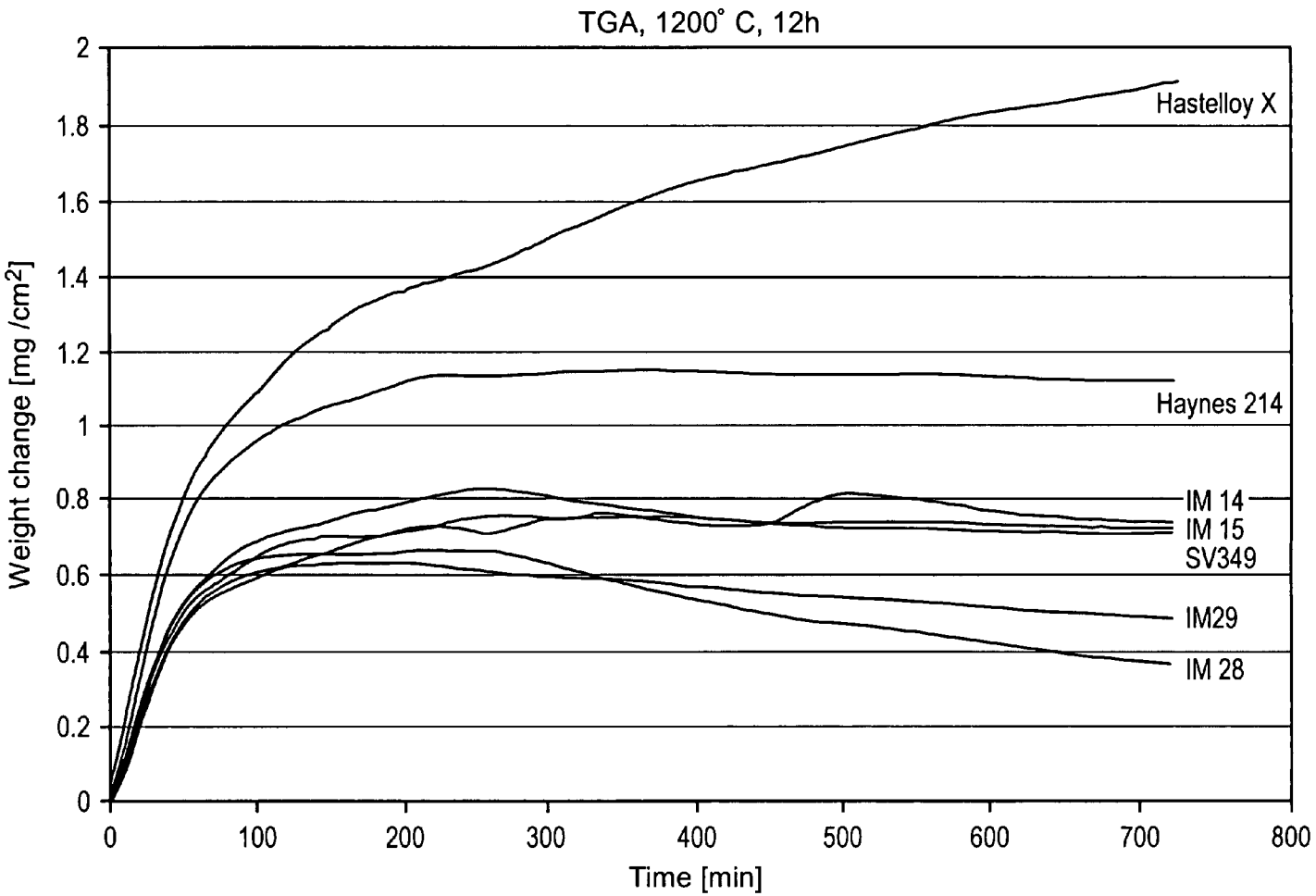
FIG. 8 shows an illustration of the oxidation properties of various materials at a temperature of 1200° C.

The advantage of the intermetallic felts 2 is the significantly improved resistance to oxidation. FIGS. 7 and 8 show the oxidation of various materials compared to the commercially available nickel-based alloys Hastelloy X, Haynes 230, Haynes 214 and the alloy SV349. Table 2 shows the composition of the tested alloys (IM28 and IM29, in particular).

Composition of tested alloys (details in weight percent)

TABLE 2

| Name | Ni | Cr | Co | Mo | W | Fe | Mn | Si | C | Al | Ta | Y | Zr | Hf | La |
|---|---|---|---|---|---|---|---|---|---|---|---|---|---|---|---|
| HasteloyX | bal | 22 | 1.5 | 9 | 0.6 | 18.5 | 0.5 | 0.5 | 0.1 | 0.3 | — | — | — | — | — |
| Haynes230 | bal | 22 | 3 | 2 | 14 | 3 | 0.5 | 0.4 | — | — | — | — | — | — | 0.02 |
| Haynes214 | bal | 16 | — | — | — | 3 | — | — | — | — | — | 0.01 | — | — | — |
| SV349 | bal | 13 | 30 | — | — | — | — | 1.2 | — | 11.5 | 0.5 | 0.3 | — | — | — |
| IM14 | bal | 22 | — | — | — | 3 | — | — | — | 10 | — | 0.2 | — | — | — |
| IM15 | bal | 9 | — | — | — | 1.6 | — | — | — | 27 | 2 | 0.2 | 0.2 | — | — |
| IM28 | bal | 22 | 36 | — | — | 3 | — | — | — | 12 | — | 0.2 | — | 0.2 | — |
| IM29 | bal | 22 | 36 | — | — | 3 | — | — | — | 10 | 2 | 0.2 | — | 0.2 | — |

FIG. 8 shows the increase in weight of the alloys indicated in Table 2 in [mg/cm$^2$] over a time of 12 hours at a temperature of 1200° C. The increase in weight is plotted as a representative measure of the oxidation of the materials. It can be seen from FIG. 8 that the comparison alloy Hastelloy X has double the increase in weight even after a short time of approx. 100 min to approx. 300 min. As time continues, the increase in weight of the Hastelloy X continues to rise further, whereas the intermetallic felts IM14 and IM15 establish a constant value of between 0.6–0.8 mg/cm$^2$, while the two alloys IM28 and IM29 are lower still. It will be clear that the resistance to oxidation of the intermetallic felts is significantly improved, since a constant oxide layer has formed. The resistance to oxidation is one of the most important factors for the service life of the component as a whole for the use according to the invention of the intermetallic felt at locations of a thermal turbomachine which are subject to friction. The two alloys IM 28 and 29 differ from the other alloys by, for example, their Co content. This increases the resistance to oxidation of the intermetallic material still further.

FIG. 7 shows an illustration that is comparable to FIG. 8, but with the tests carried out at a temperature of 1050° C.

To increase the strength of this turbine blade or vane 1 as shown in FIG. 1 still further at the tip 11, the intermetallic felt 2 may be covered with a ceramic material 3, for example with a TBC (thermal barrier coating). TBC is a Y-stabilized Zr oxide. However, equivalent materials are also conceivable. The ceramic material 3 may be sprayed onto the intermetallic felt 2, and the uneven surface of the intermetallic felt 2 means that the ceramic material is very securely held thereon and provides a good resistance to oxidation. The ceramic material 3 offers good protection against thermal and mechanical, for example friction-induced, effects. Cooling-air bores which may be present in the turbine blade or vane 1 or at the rotor/stator 4 advantageously cannot become blocked, since the intermetallic felt 2 is a porous material.

Figure 2:
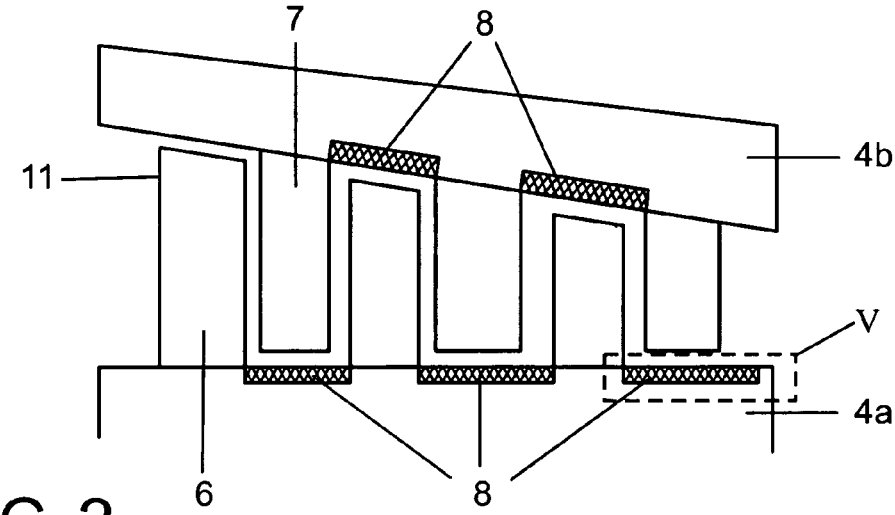
FIG. 2 shows an embodiment of a gas turbine with heat shield segments which are arranged opposite the guide vane or rotor blade and consist of an intermetallic felt.

FIG. 2 illustrates a further embodiment. FIG. 2 diagrammatically depicts an illustration of a gas turbine having a rotor 4*a*, and a stator 4*b*. Rotor blades 6 are secured to the rotor 4*a*, and guide vanes 7 are secured to the stator 4*b*. Heat shield segments 8 are usually arranged opposite the guide vanes/rotor blades 6, 7 on the rotor 4*a* or stator 4*b*, respectively. According to the invention, these heat shield segments 8 may likewise partially or completely comprise an intermetallic felt. The porous properties allow improved cooling at this location even if abrasion has occurred, since the porous structure of the intermetallic felt prevents blockages. As has already been described, the abrasion may be reduced by a layer of TBC. The component may also be cooled beneath the TBC layer, since the cooling medium can escape laterally through the porous felt.

Figure 5:
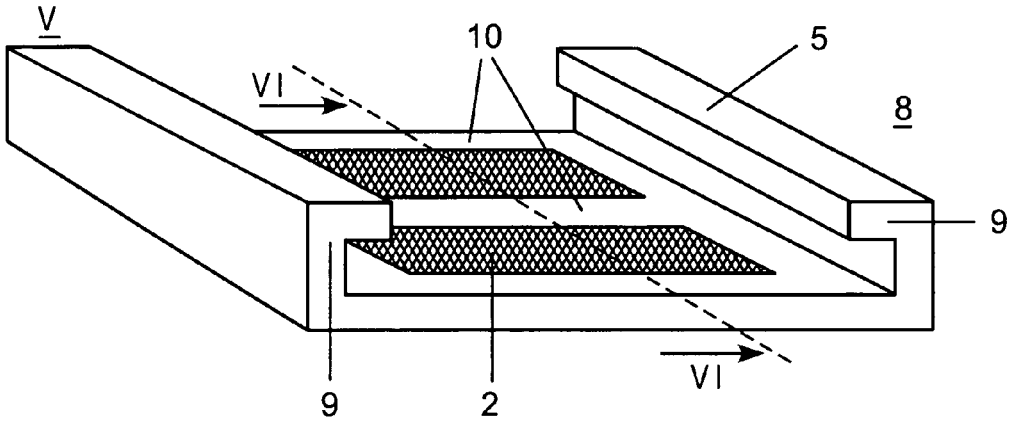
FIG. 5 shows a heat shield segment according to the invention with a supporting substructure in accordance with excerpt V from FIG. 2.

FIG. 5 shows a heat shield segment 8 according to the invention corresponding to excerpt V from FIG. 2. The intermetallic felt 2 has been placed on a supporting substructure 5. The supporting substructure 5 has securing means 9 which are used to secure it to the rotor 4*a* or stator 4*b* (not shown in FIG. 5). The lateral securing means 9 are connected to one another by struts 10. On the side which faces the turbine blades or vanes, the intermetallic felt 2 is inserted between the struts 10 and mechanically connected to it. This connection can be effected, for example, by soldering, welding or casting. For durability reasons, the felt should be cohesively secured to the supporting substructure 5.

Figure 6:
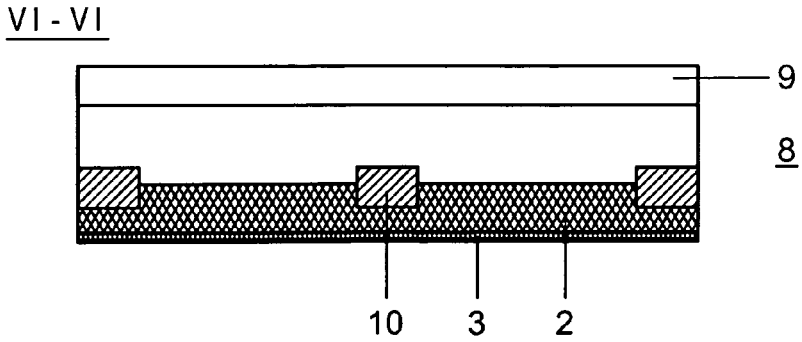
FIG. 6 shows a section through the heat shield segment corresponding to line VI—VI in FIG. 5.

FIG. 6 shows section VI—VI from FIG. 5. It can be seen from the sectional illustration that the struts 10 which connect the two securing means 9 do not penetrate through the intermetallic felt 2, but rather the intermetallic felt 2 is merely secured to them. As can be seen from FIG. 6, to further increase the thermal stability of the heat shield segment 8, the intermetallic felt 2 may in turn be covered with a ceramic material 3, for example with a TBC (thermal barrier coating). However, equivalent materials are also conceivable. As in the case of the turbine blade or vane 1 shown in FIG. 1, a cooling action is retained even in the event of abrasion, since the intermetallic felt 2 does not become blocked.

Figure 3:
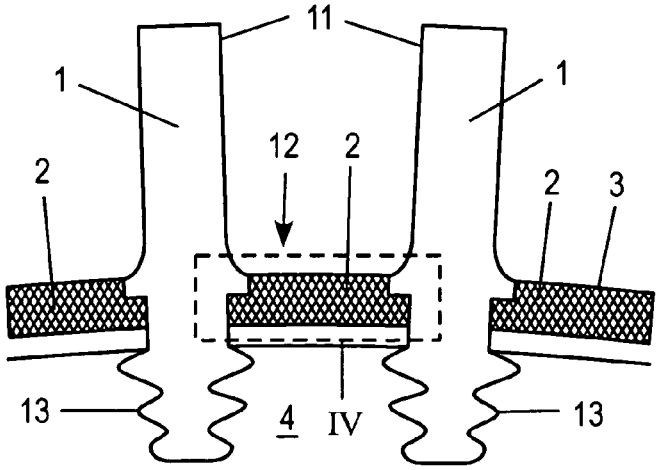
FIG. 3 shows a second embodiment of a turbine blade or vane according to the invention, with the intermetallic felt arranged on the platform of the turbine blade or vane.

For improved cooling, in the exemplary embodiment shown in FIG. 3, the intermetallic felt has been placed on the platform 12 of the turbine blade or vane 1 of the thermal turbomachine. In this case too, it is appropriate, as has already been described in connection with FIGS. 1, 2, 5 and 6, for the felt 2 to be covered with a ceramic material 3. This has the advantage that the TBC bonds particularly well to the intermetallic felt and the felt is resistant to oxidation. There is no need for an additional bonding layer (e.g. MCrAlY). This is illustrated in FIG. 3 in addition to the straight turbine blade or vane 1. The TBC also serves as a protection against wear.

Figure 4:
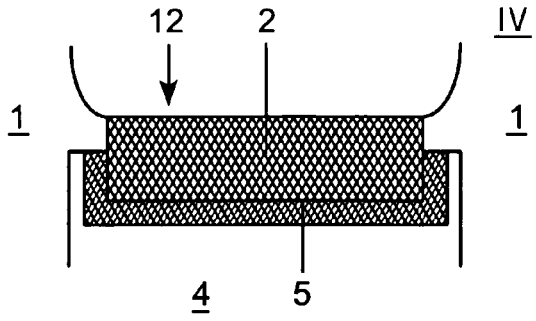
FIG. 4 shows a variant of the second embodiment of detail IV from FIG. 3, with the intermetallic felt arranged between the turbine blades or vanes, on the platforms of the turbine blades or vanes on a supporting substructure.

FIG. 4 shows a second variant of the exemplary embodiment of detail IV from FIG. 3. The intermetallic felt 2 is secured, between two turbine blades or vanes 1—on the platform 12 of the turbine blade or vane 1—to a supporting substructure 5, comprising a cast metal part or some other metal. The supporting substructure 5 may also comprise various chambers in order to ensure an optimum supply of air to the intermetallic felt 2.

The intermetallic felt can also be used at locations within the gas turbine which are subject to vibrations, since in addition to being resistant to oxidation as described above, the felt also has very good vibration-damping properties.

On account of its materials properties, an intermetallic material according to the invention may advantageously also be used as a high-temperature coating 15 on the turbine blades or vanes or other components. As can be seen from FIGS. 8 and 7, the two alloys likewise have improved properties with regard to oxidation when compared to the alloy SV 349. The prior art has disclosed various coating processes allowing the protective layer to be applied to a turbine blade or vane of this type, for example a plasma spraying process. In this case, a metallic powder consisting of the material that is to be applied is introduced into a flame or a plasma jet. This powder melts at that location and is sprayed onto the surface that is to be coated, where the material solidifies and forms a continuous layer.

A physical (or chemical) vapor deposition process is also possible. In this process, solid coating material in block form is heated and evaporated (e.g., using a laser or an electron beam). The vapor precipitates on the base material, where after a suitable time it forms a coating. Other equivalent coating processes are also conceivable.

The invention claimed is:

1. An intermetallic material, consisting of the following composition, by weight percent: 12% Al, 22% Cr, 36% Co, 0.2% Y, 0.2% Hf, 3% Fe, remainder Ni and inevitable impurities.

2. An intermetallic material, consisting of the following composition, by weight percent: 10% Al, 22% Cr, 36% Co, 0.2% Y, 0.2% Hf, 2% Ta, 3% Fe, remainder Ni and inevitable impurities.

3. A method of using the intermetallic material as claimed in claim 1, comprising steps of coating at least a portion of a thermal turomachine with the intermetallic material.

4. The method of using the intermetallic material as claimed in claim 1, comprising steps of forming a felt comprising the intermetallic material on components which are subject to friction in thermal turbomachines.

5. The use method of using intermetallic felt as claimed in claim 4, wherein the intermetallic felt is disposed on a rotor or stator.

6. The method of using the intermetallic felt as claimed in claim 4, wherein the component is a turbine blade or vane, and the tip of the turbine blade or vane is provided with intermetallic felt.

7. The method of using the intermetallic felt as claimed in claim 4, wherein the component is a turbine blade or vane and the platform of the turbine blade or vane is provided with the intermetallic felt.

8. The method of using the intermetallic felt as claimed in claim 4, wherein the component is a heat shield segment made partially or completely from the intermetallic felt.

9. The method of using the intermetallic felt as claimed in claim 4, wherein the intermetallic felt is covered with a ceramic material.

10. The method of using the intermetallic felt as claimed in claim 4, wherein the felt is used on components which are subject to vibration in thermal turbomachines.

* * * * *